United States Patent [19]

Salmi et al.

[11] 4,369,848

[45] Jan. 25, 1983

[54] CONTROL SYSTEM FOR A ROCK DRILL

[75] Inventors: Pekka Salmi; Aimo Helin, both of Tampere, Finland

[73] Assignee: Oy Tampella Ab, Finland

[21] Appl. No.: 36,550

[22] Filed: May 7, 1979

[30] Foreign Application Priority Data

May 11, 1978 [FI] Finland ..... 781485

[51] Int. Cl.[3] ..... E21C 5/16

[52] U.S. Cl. ..... 173/8

[58] Field of Search ..... 173/8

[56] References Cited

U.S. PATENT DOCUMENTS 3,802,514 4/1974 Ein et al. ..... 173/8

3,979,944 9/1976 Salmi et al. ..... 173/8

4,023,626 5/1977 Salmi et al. ..... 173/8

4,064,950 12/1977 Salmi et al. ..... 173/8 X 4,109,734 8/1978 Montabert .

*Primary Examiner*—Robert Mackey

*Attorney, Agent, or Firm*—Hill, Van Santen, Steadman, Chiara & Simpson

[57] ABSTRACT

A hydraulic control system for use with a rock drill is adapted to sense a pressure build-up in the drill's rotation motor and in response thereto, to reverse the direction of feed of the feed motor as well as to supply hydraulic fluid to a shank cylinder on the rock drill. Supplying hydraulic fluid to the shank cylinder assists in freeing the drill from the rock.

2 Claims, 4 Drawing Figures

CONTROL SYSTEM FOR A ROCK DRILL

This invention relates to a pressure medium operated control system for a rock drill to prevent the drill steel from getting stuck and to release the drill steel if stuck, which system comprises a striking apparatus, a rotation motor and a feed motor with control valves and sources for pressure medium and, at the striking end of the drill rod, a shank adapter which can be brought into striking contact with the striking piston by means of a shank cylinder and a thereto connected pressure medium source, also during the return movement of the drill.

When drilling into fissured rock the drill steel may get stuck. If the drill steel is stuck, the rotation resistance increases strongly. The sticking is normally prevented by reversing the direction of feed automatically when the rotation resistance reaches a preset limit. It is known, for example, in U.S. Pat. No. 4,109,734 how to release the drill bit more effectively by lifting the drill rod into striking contact with the striking piston by means of a shank cylinder which is connected to the shank adapter of the drill rod, whereby the bit can be shaken free by means of the stroke during the return movement of the drill. Thus the bit is released by lighter feed force and more securely.

The object of the invention is to accomplish a control system for a rock drill of the above-mentioned type, by which control system the operation of the rotation, the feed and the shank cylinder connected to the shank adapter are simply and securely made interdependent in a purposeful manner.

This object is achieved according to the invention so that pressure medium is fed into the said shank cylinder through a pressure controlled directional control valve which is controlled through the pressure line or the rotation speed of the rotation motor and that the reversing of the feed motor from feed of the rock drill into its return movement is caused to take place substantially at the same pressure value of rotation circuit or at the same rotation speed at which the said directional control valve starts to let pressure medium into the shank cylinder.

The control of the reversing of the feed motor is simpliest to arrange so that the return line of the feed circuit is connected to the pressure line of the rotation circuit. If the drill steel has got stuck and the pressure in the rotation circuit exceeds the preset value, the feed direction is changed while the striking contact of the drill steel is maintained through the operation of the said shank cylinder.

According to an advantageous embodiment of the invention, the desired control pressure for the pressure controlled directional control valve can be directed with a hand valve through a shuttle valve. Thereby the striking contact with the shank of the drill steel is maintained, for example, when releasing drill steel couplings with light feed force without rotation, or when releasing a drill steel that has got stuck, for example, due to insufficient flushing, with strong return feed without rotation.

In the following, a preferable embodiment of the invention will be described with reference to the accompanying drawings.

Figure 1:
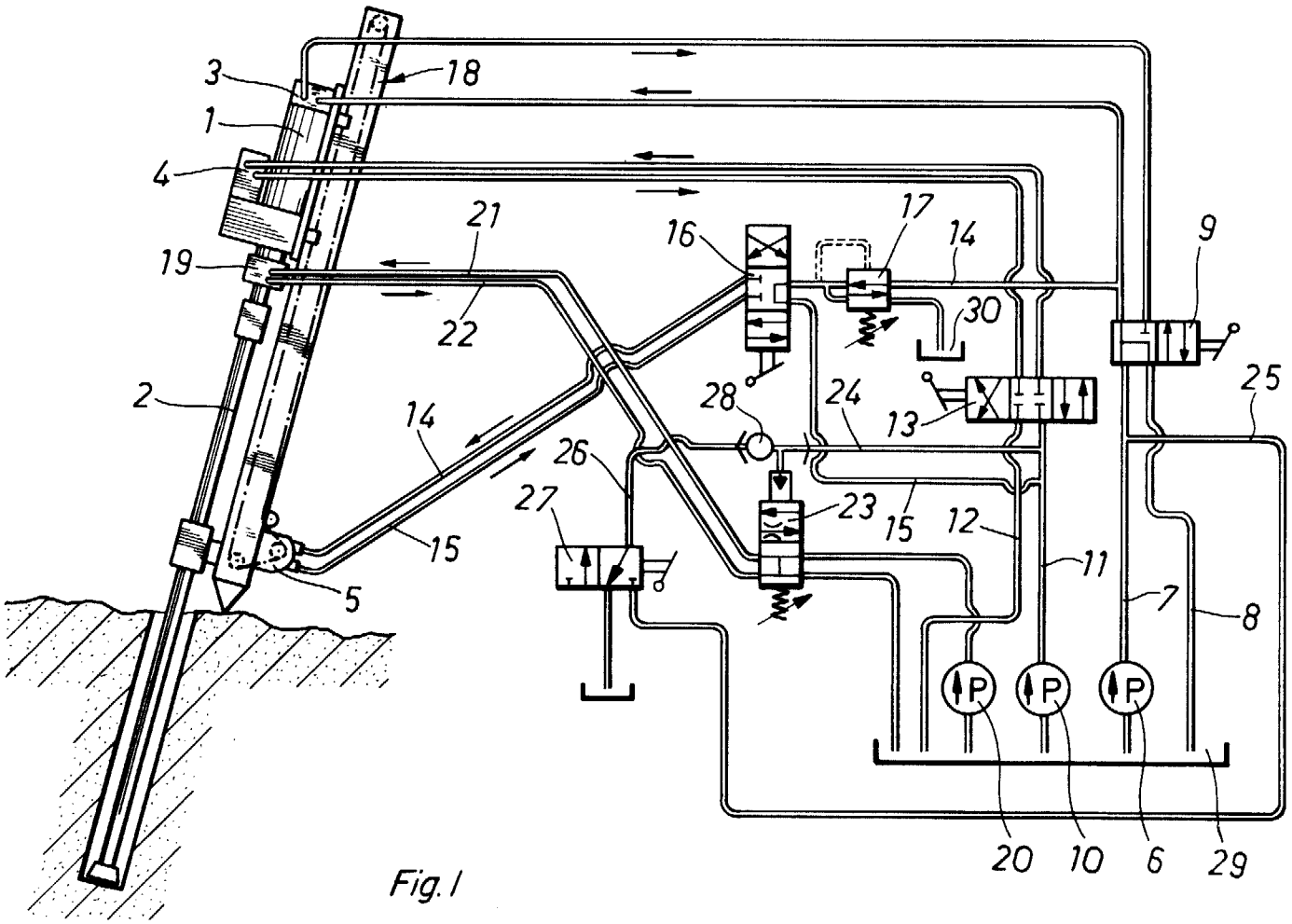
FIG. 1 shows the scheme of the control system for a rock drill according to the invention. In this application "to the front" and "forwards" shall mean the drilling direction and "behind" and "backwards" shall mean the opposite direction.

The drill steel 2 is operated in the usual way by a rock drill 1 comprising a striking apparatus 3, a rotation motor 4 and a feed motor 5. With these members are incorporated

- a striking circuit comprising a source 6 for pressure medium, a pressure line 7, a striking apparatus 3, a return line 8 and a directional control valve 9.
- a rotation circuit comprising a source 10 for pressure medium, a pressure line 11, a rotation motor 4, a return line 12 and a directional control valve 13.
- a feed circuit comprising a pressure line 14, a feed motor 5, a return line 15, a directional control valve 16 and a pressure reducing directional valve 17.

The feed motor 5 is a part of the feeding device 18, by means of which both the drilling movement and the return movement of the rock drill 1 is obtained. The construction of the striking apparatus 3, the rotation motor 4, the feed motor 5 and the feed device 18 is of the type well known by those familiar with the art, and therefore their construction and function will not be described in more detail. At the rear end of the shank of the drill steel 2, there is additionally a shank cylinder 19 that is described for example in Finnish patent application 781486 and its corresponding U.S. application Ser. No. 036,652, filed May 7, 1979. It incorporates a shank cylinder circuit comprising a pressure medium source 20, a pressure line 21, a shank cylinder 19, a return line 22 and a pressure controlled directional control valve 23. By means of the shank cylinder 19, the drill steel 2 can be brought into striking contact with the striking piston of the striking apparatus also during the return movement of the rock drill i.e. when the drill steel 2 is subject to no forward feed force. The striking apparatus 3 gets pressure medium from the pump 6 through the valve 9, and the rotation motor 4 from the pump 10 through the valve 13. The feed motor 5 receives pressure medium from the pressure line of the striking circuit through the valves 17 and 16.

The return line 15 of the feed circuit is connected with the pressure line 11 of the rotation circuit. The shank cylinder 19 receives pressure medium from the pump 20 through the pressure controlled directional control valve 23. The pressure controlled directional control valve 23 obtains its control through the line 24 from the pressure line 11 of the rotation circuit or alternatively from a desired pressure medium source, for example from the pressure line 7 of the striking circuit along the pipes 25 and 26 by the hand valve 27 through the shuttle valve 28. In FIG. 1 the position of the hand valve 27 corresponds to the former alternative. The other position of the valve 27 corresponds to the latter alternative. In a normal drilling situation the directional control valve 23 is in the position according to FIG, 1, whereby the oil brought by the pump 20 returns from the valve 23 back to the tank 29. The valve 23 is adjusted to change its position at a preset pressure. In the other position, the inlet and outlet lines 21 and 22 of the shank cylinder open. The return line 22 can be choked in order to cause pressure rise in front of the piston of the shank cylinder.

The valves 9, 13 and 16 are normal directional control valves. Valve 17 is a normal pressure reducing directional valve for which a pressure can be preset at which the valve changes the flow direction.

The operation of the control system is as follows:

The pump 6 of the striking apparatus generates the highest pressure of the system, e.g. 140 bar. The necessary pressure and volume for the feed are then obtained from the pressure line 7 of the percussion circuit through the pressure reducing directional valve 17. Because the return line 15 of the feed circuit is in connection with the pressure line 11 of the rotation circuit, the pressure medium flows in normal drilling situation from the feed motor 5 into the pressure line 11 of the rotation circuit. The feed circuit pressure needed may then be, for example, 100 bar and the pressure of the rotation circuit about 50 bar.

If the rotation resistance increases strongly, the discharge pressure of the pressure medium source of the rotation circuit rises. Thereby the feed gets respectively lighter because the pressure difference over the feed motor 5 decreases. When the pressure of rotation reaches a preset limit, e.g. 100 bar, the pressure controlled directional control valve 23 changes its position and directs the hydraulic pressure medium from the pump 20 to the shank cylinder 19. At the same time, the pressure in the return line 15 of the feed circuit rises respectively and when it reaches the preset limit, e.g. 100 bar, the valve 17 changes position, whereby the flow from the pressure line 7 of the striking circuit is closed and the line into the tank 30 is opened.

The flow direction in the feed motor 5 is changed, because now the pump 10 of the rotation motor produces pressure medium into the feed circuit. The drill moves backwards and the steel is released. The pressure affecting the shank cylinder 19 keeps the drill steel 2 during retract in its rear position, whereby the striking contact with the shank of the drill steel is maintained. When the steel is released, the rotation resistance decreases and the directional control valve 23 returns into its normal position and the valve 17 opens again the connection from the pressure line 7 into the feed motor 5 and forward feeding takes place.

Pressure can be directed into the shank cylinder 19 also by the hand valve 27 through the shuttle valve 28 which operates the directional control valve 23. In the present case, the pressure for this alternative is obtained from the pressure line 7 of the striking circuit through the line 25, but it can be obtained also from other pressure medium sources. Thereby the striking contact with the shank of the drill steel 2 is accomplished by the shank cylinder 19 always when needed, for example when releasing drill steel couplings with light feed force without rotation and when releasing a drill steel that has got stuck, for example, due to insufficient flushing, with strong return feed without rotation.

Figure 1A:
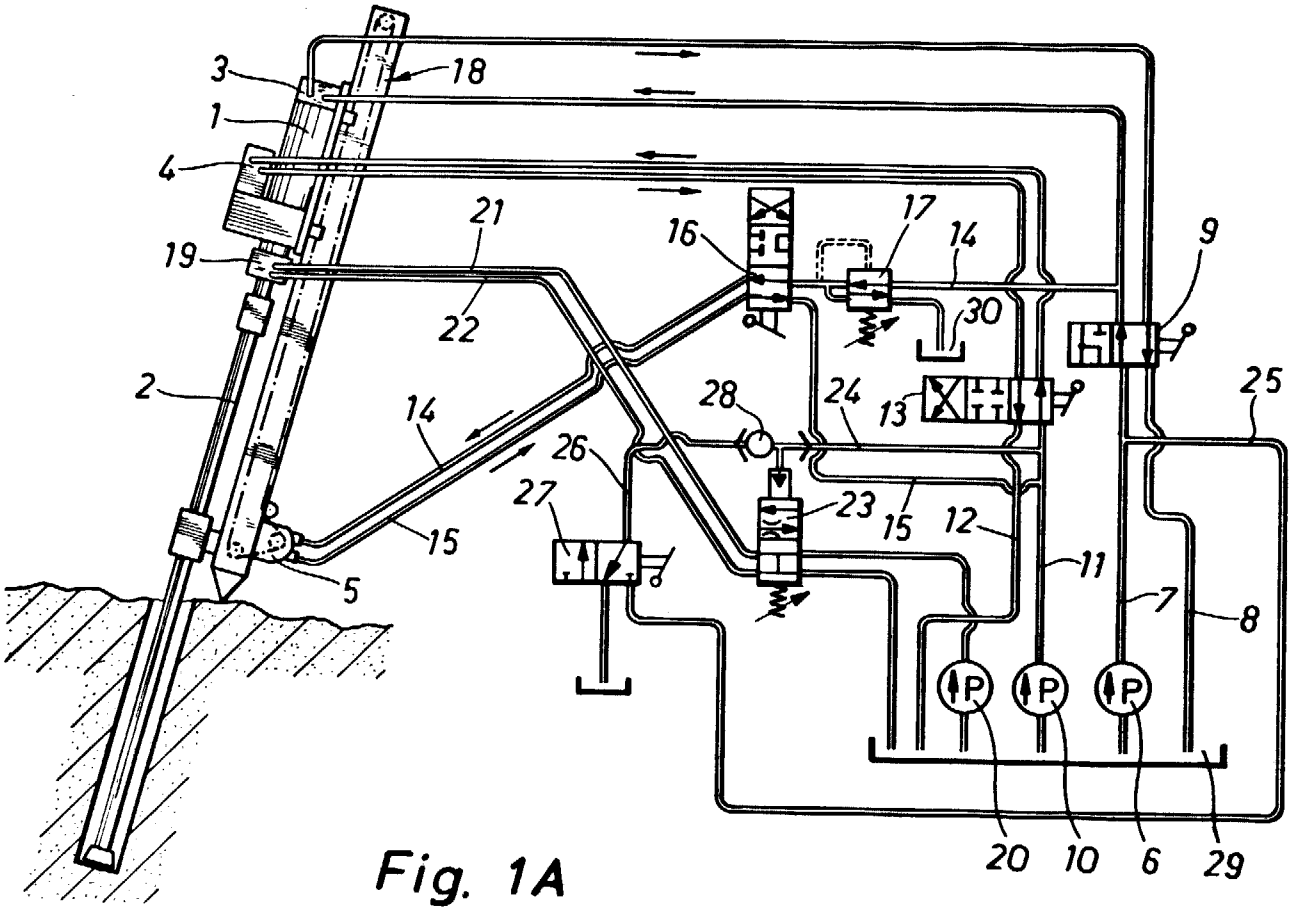
FIG. 1A shows the control system of FIG. 1 under normal operating conditions with the drill steel advancing into the rock.

FIG. 1A shows the control system of FIG. 1 under normal operating conditions where the tool steel 2 has not become jammed. In FIG. 1A, the rotary motor 4 is able to rotate the tool steel 2 in normal operating fashion, and the advance motor 5 advances steel 2 into the rock.

Figure 1B:
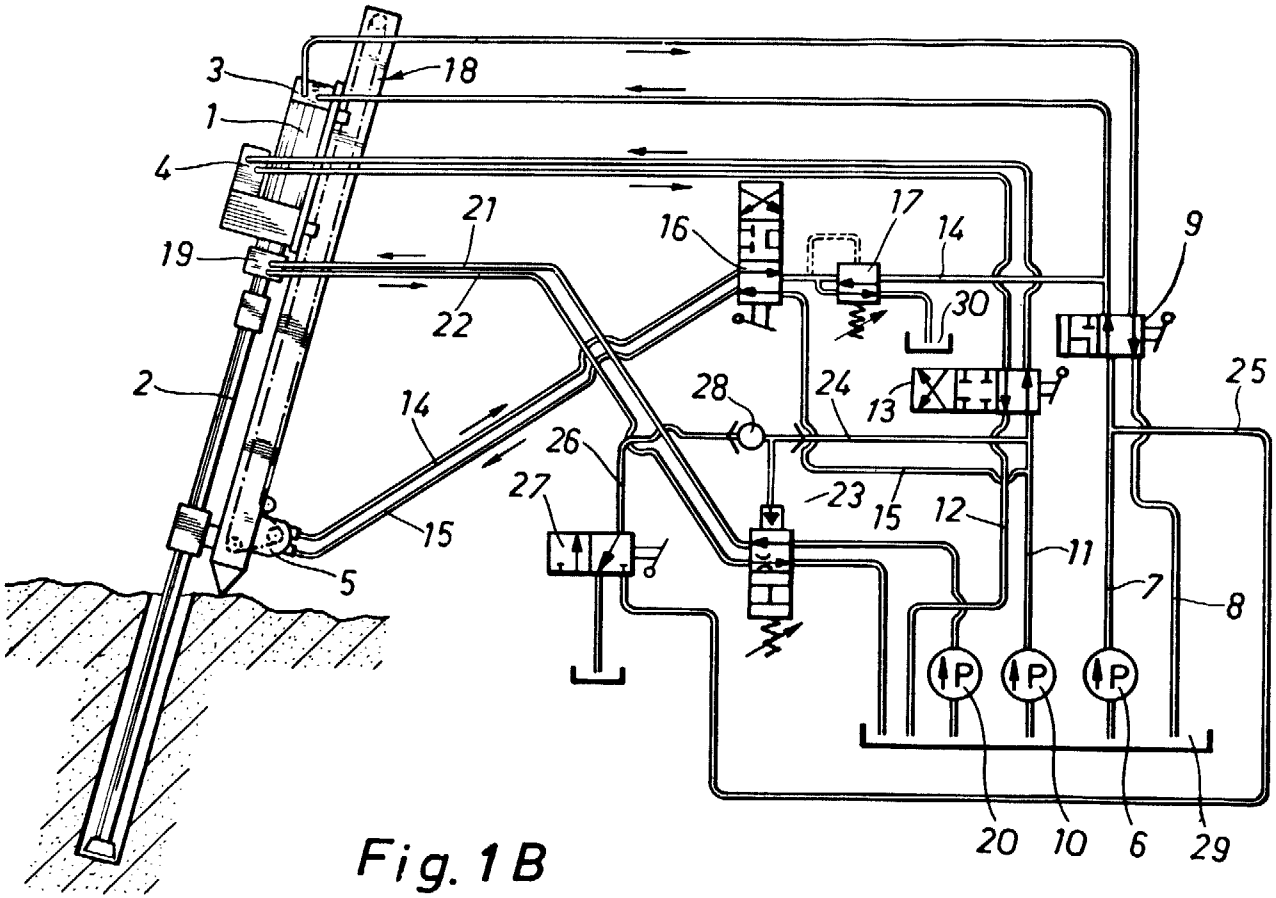
FIG. 1B shows the control system of FIG. 1 where the drill steel has become jammed, the advance motor has been reversed, and the shank cylinder has been filled with hydraulic medium.

FIG. 1B discloses the control system of FIG. 1 in a condition where the tool steel 2 has become jammed and the rotary motor 4 is unable to continue to rotate the tool steel. In this condition, pressure in the line 11 which normally drives the rotary motor 4 in a first rotary direction increases. This pressure increase in turn increases pressure in lines 14 and 15 which are connected to advance motor 5. In FIG. 1B, pressure in line 14 has increased to a predetermined value such that spring biased valve 17 has changed state. As a result, line 14 has been disconnected from pressurized line 7. Instead, line 14 has been connected to sink 30. In this condition, hydraulic medium from line 11 flows through line 15 reversing feed motor 5 through line 14 through valve 17 and into sink 30. Thus, the tool steel 2 is moved away from the rock. Simultaneously, pressurized medium from line 11 connected through line 24 and shuttle valve 28 to valve 23 has caused the valve 23 to change state. As a result, hydraulic medium from pump 20 is forced through line 21 into shank cylinder 19. This causes shank cylinder 19 to operate further effectuating the disengagement of tool steel 2. In FIG. 1B, the pressure in line 26 is lower than the pressure in line 24. As a result, line 24 is connected to a pressure control input to the valve 23.

Figure 1C:
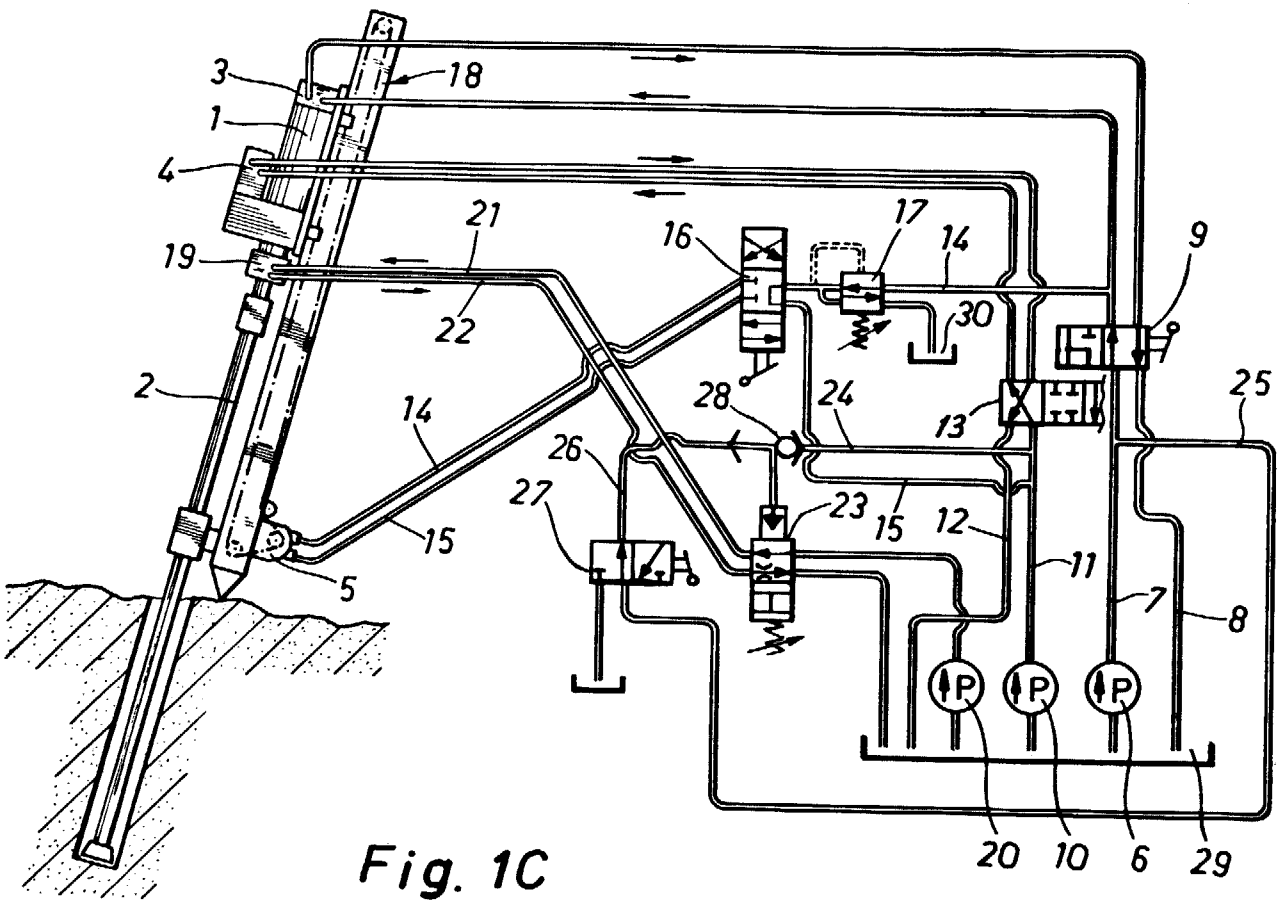
FIG. 1C shows the control system of FIG. 1 where a manually actuated valve has been operated to cause hydraulic media to fill the shank cylinder.

FIG. 1C discloses the control system of FIG. 1 in a condition where manually operated valve 27 has been opened connecting pressurized line 7 via line 25 to shuttle valve 28. As noted previously, the pressure in line 7 is the highest in the control system. Thus, with valve 27 in the position shown in FIG. 1C, line 26 has a higher pressure than does line 24. As can be seen in FIG. 1C, shuttle valve 28 has changed position with respect to the position it occupied in FIGS. 1, 1A and 1B, due to the pressure in the line 26. As a result, the hydraulic media from pressurized line 7 is connected to the control line of valve 23, thereby causing valve 23 to change state and energize shank cylinder 19.

We claim:

1. A control system for operating a hydraulic drilling machine, the drilling machine includes a body, a drill steel reciprocatingly and rotatably supported by the body and having a shank at its rear end inside the body, a striking apparatus with a striking piston adapted to strike against the shank, a rotation motor with gear means adapted to rotate the drill steel in either direction, a feed motor operating a feed device to cause forward and return movements of the drilling machine, and a shank cylinder with a shank piston therein adapted to retract the drill steel with the shank in a striking contact with the striking piston when a pressure medium is supplied to the shank cylinder, the control system comprising:

first means for supplying a pressure medium coupled through a first pair of supply and return lines to the striking apparatus, second means for supplying a pressure medium coupled through a second pair of supply and return lines to the rotation motor, wherein said first means for supplying a pressure medium has a higher pressure than does said second means for supplying a pressure medium, manually operable valve means in said second pair of supply and return lines, said valve means being a directional valve adapted to reverse the direction of flow of the medium thereby to cause the rotation motor to rotate the drill steel in either direction, a third pair of supply and return lines for the feed motor, a supply line of said third pair is connected to a supply line of said first pair and a return line of said third pair is connected to a supply line of said second pair so as to normally operate the feed motor with a pressure differential therebetween, third means for supplying a pressure medium coupled through a fourth pair of supply and return lines to the shank cylinder, first pressure controlled valve means associated with said supply line of said third pair of supply and return lines, said first pressure controlled valve means being adapted to sense a predetermined increased pressure in said supply line of said second pair of supply and return lines, said pressure being increased due to increased rotation resistance encountered by the drill steel, and to change from one flow condition to another disconnecting said supply line of said third pair of supply and return lines from said supply line of said first pair and connecting said supply line of said third pair of supply and return lines to a tank, thereby reversing the direction of flow of pressure medium in the feed motor causing that motor to reverse the feed direction, second pressure controlled valve means associated with said fourth pair of supply and return lines for the shank cylinder with a pressure control line of said second valve connected to said rotation supply line of said second pair of supply and return lines, said second pressure controlled valve means being adapted to change from a closed to an open condition at a predetermined rotational pressure in said control pressure line thereby allowing pressure medium to enter the shank cylinder through a supply line of said fourth pair and choking a return line of said fourth pair in order to cause pressure to rise in front of the shank piston thereby to cause the retracting operation of the shank piston to take place, the predetermined rotational pressure selected to actuate said second pressure controlled valve means substantially corresponding to the predetermined increased pressure sensed to change the feed direction, said first and second pressure controlled valve means returning to said initial flow conditions once the second pressure has dropped below said selected value.

2. The control system for operating a hydraulic drilling machine according to claim 1, wherein said pressure control line of said second pressure controlled valve means is connected to an output of a two input shuttle valve, a first input to said shuttle valve is connected to said rotational supply line of said second pair of supply and return lines, said second input is connected via a line to an output of a hand operated two position valve, an input to said valve is connected to said first pressure source, an output of said valve is connected to a tank, said shuttle valve being adapted to alternately open a pressure medium flow path from either said first pressure source or said rotation supply line of said second pair to said pressure control line of said second pressure controlled valve to close said other pressure medium flow path in response to the position of said hand operated valve.

* * * * *